US005947337A

United States Patent [19]

Worth

[11] Patent Number: 5,947,337

[45] Date of Patent: Sep. 7, 1999

[54] ROTARY UNION

[75] Inventor: John Numa Worth, Bolnhurst, United Kingdom

[73] Assignee: W.R. Grace & Co.-Conn., New York, N.Y.

[21] Appl. No.: 08/930,549

[22] PCT Filed: Apr. 2, 1996

[86] PCT No.: PCT/GB96/00805

§ 371 Date: Dec. 24, 1997

§ 102(e) Date: Dec. 24, 1997

[87] PCT Pub. No.: WO96/31290

PCT Pub. Date: Oct. 10, 1996

[30] Foreign Application Priority Data

Apr. 6, 1997 [GB] United Kingdom ..... 9507145

[51] Int. Cl.[6] ..... B67D 5/64

[52] U.S. Cl. ..... 222/168; 222/64; 222/160; 222/167; 222/394; 141/198; 366/220; 366/232

[58] Field of Search ..... 141/144–147, 141/198; 222/160, 64, 537, 167, 168, 394; 118/318, 319, 409, 694; 53/129.1, 137.2, 370.3, 373.3; 366/220, 232, 153.1

[56] References Cited

U.S. PATENT DOCUMENTS 3,515,180 6/1970 Friendship ..... 141/6

FOREIGN PATENT DOCUMENTS

A 738 428 12/1932 France .
2200059 7/1988 United Kingdom .

*Primary Examiner*—Henry J. Recla
*Assistant Examiner*—Timothy L. Maust
*Attorney, Agent, or Firm*—Craig K. Leon; William L. Baker

[57] ABSTRACT

A rotary union for dispensing of a single central supply of water-based can sealing compound to an orbiting can end lining station includes a rotating reservoir (1) inside a stationary housing (2) with a dip tube (3) carried by the housing extending down below the liquid level of the reservoir. A sensor (4) in the ceiling of the housing determines the liquid level for controlling the admission of the compound through the down tube in response to the level sensed. The seal (7), where the stationary and rotating parts interface, is below the reservoir and simply needs to support gas pressure but does not come into contact with the compound.

6 Claims, 1 Drawing Sheet

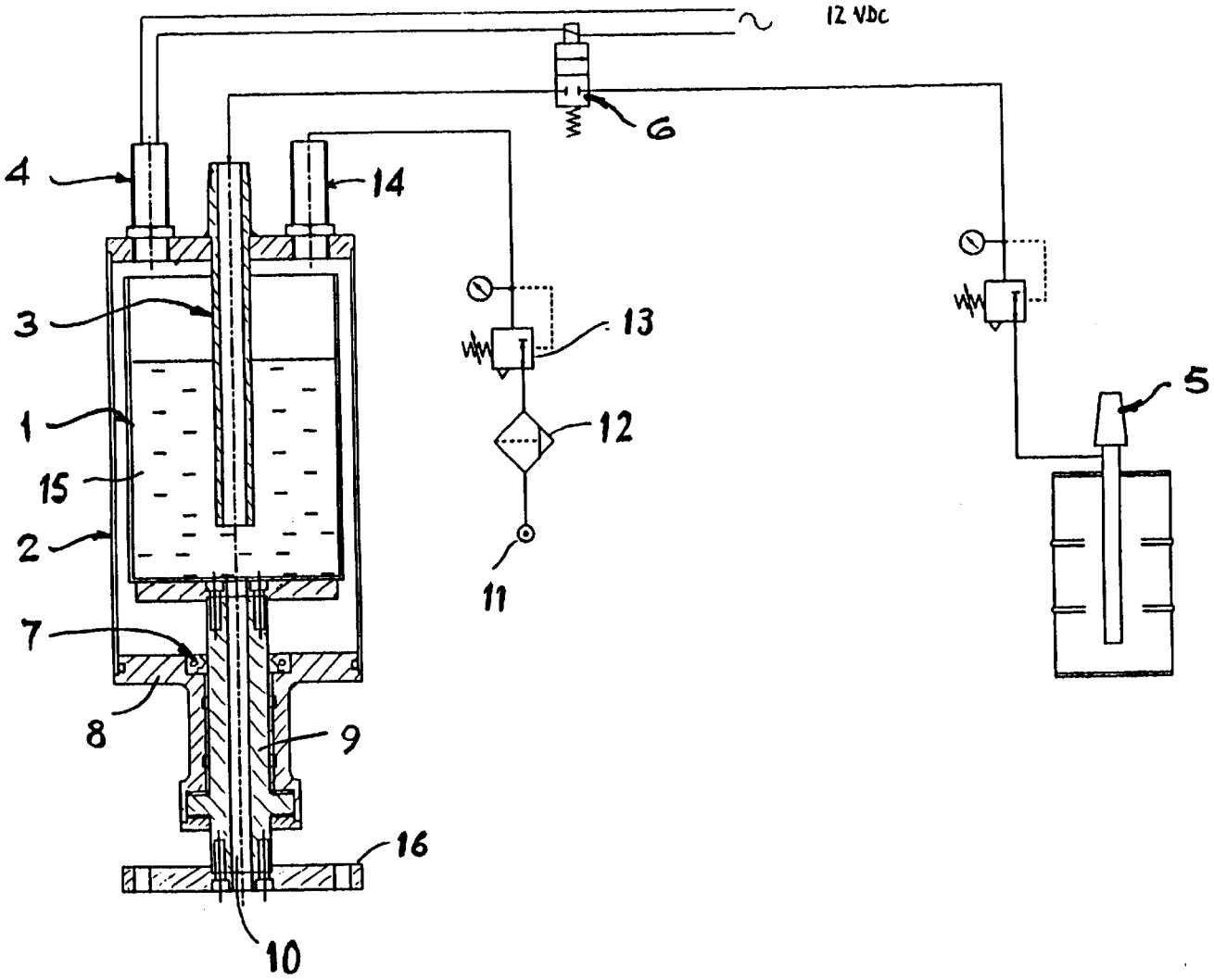
12 VDC
5
6
13
12
11
14
16
9
10
4
3
1
15
2
7
8

ROTARY UNION

The present invention relates to a rotary union, and in particular to a fluid-fillable rotary union where the fluid is one which reacts to shear stresses.

One example of such a fluid is a water-based can sealing compound, which is an aqueous suspension of rubber and other ingredients, used for providing a sealing gasket in a can end.

BACKGROUND

It is known to use a rotary can end lining machine in which the can sealing compound is dispensed on a turret arrangement to which there is a single feed of compound, and then distribution of the liquid compound to several lining stations around the periphery of the turret so that the compound can be dispensed while the turret is rotating and while the lining stations are orbiting around the axis of rotation of the turret.

For many years a turret has been used in which the can sealing compound is supplied in this way, but the compound has usually been a solvent-based compound in which rubber and resin are dissolved in a solvent and fillers are in suspension. Such a compound is not susceptible to the effects of shear.

The solvent would evaporate during drying, to leave a solid gasket. More recently, in order to avoid the emission due to evaporation of solvents, there has been a move towards water-based can sealing compounds and it has been found to be a disadvantage of such compounds that shear forces in the liquid, for example at any interface between stationary and rotating parts of the apparatus, give rise to coagulation of the compound which causes a build-up of the coagulated compound locally in the rotary union of the turret, and eventually interference with the flow of compound to the individual moulding stations.

There have been various attempts made in the past to avoid such a problem. For example, GB-A-2200059 uses a rotatable reservoir with flow into that reservoir vertically downwardly through a stationary dip tube on which are also mounted liquid level detectors to control the inlet of suspension into the reservoir within predetermined upper and lower limits. This will ensure that the interface between the suspension and the gas space thereabove remains well below the rotary seals between the stationary dip tube and the lid of the rotating reservoir. While such an arrangement does minimize the risk of contact of liquid with adjacent rotating and stationary surfaces of the apparatus at the seals, which occur well above the level of the reservoir around an upward extension of the dip tube, the fact that the reservoir is rotating around the stationary dip tube (for example at around 100 rpm) can present problems.

SUMMARY OF THE INVENTION

In accordance with the present invention there is provided a rotary union for distributing a flow of liquid to an orbiting use location, comprising a stationary housing supporting a dip tube for introduction of the liquid flow, an upwardly open reservoir cup surrounding said dip tube and supported for rotation within said stationary housing, a hollow shaft extending downwardly from the floor of said reservoir centered on the axis of rotation of the reservoir cup and passing through a stationary floor of said housing to define an outlet from said reservoir, and a sensor in the ceiling of said housing for detecting the level of liquid in said reservoir cup for controlling liquid-admission means to said dip tube.

BRIEF DESCRIPTION OF THE DRAWING

In order that the present invention may more readily be understood the following description is given, merely by way of example, with reference to the accompanying drawing, in which the sole Figure shows a schematic view of the control circuitry and the suspension feed components, together with a sectional view of the rotary union for applying a single supply of the can sealing compound at the hub of a rotating turret.

DETAILED DESCRIPTION OF THE EXEMPLARY EMBODIMENT

In the drawing the open cup-shaped reservoir 1 rotates inside a stationary housing 2 to which a stationary dip tube 3 is attached.

The housing 2 also supports a sensor 4 for determining the level of liquid in the reservoir 1. Access can be gained to the sensor 4 from outside the housing 2.

The pump 5 draws water-based can sealing compound from a supply barrel and feeds it by way of (i) a pressure regulator and (ii) a solenoid-operated valve 6 which is controlled by the signals from the sensor 4.

A gas-tight seal 7, below the reservoir provides a sealing action between a stationary floor 8 to the housing 2 and a rotating downwardly extending output shaft 9 from the rotating reservoir 1. This shaft 9 includes a through bore 10 for discharge of the can sealing compound from the reservoir 1. The seal 7 is in this case a face seal between (i) a carbon face of a rotary part on the shaft 9 and (ii) a ceramic face on a stainless steel housing let into the floor of the housing 2.

The interior of the housing 2 is pressurized by means of an air supply 11 feeding air through a filter set 12 and a pressure regulator 13 to an inlet port 14 where the pressure, controlled by the regulator 13, can be in the range of from 1.5 bar to 3 bar. This maintains the interior of the housing 2 and the reservoir 1 under a clear positive pressure which helps to propel the can sealing compound down the shaft 9 and towards the dispensing nozzles (not shown).

By virtue of the sensor 4, which is stationary and can be accurate in operation using any one of a number of different sensing actions including optical, ultrasonic, conductive and capacitive, the admission of compound via the valve 6 is controlled to ensure that the level of the compound 15 in the reservoir 1 is such that the bottom of the dip tube will always be below the gas/liquid interface in the reservoir and also that the interface will be well below the upper rim of the rotating reservoir, thereby ensuring there is minimum risk of splashing of compound over the rim of the reservoir so as to come in contact with the seal region 7 where high shear would exist and where the effects of coagulation of the compound would be disadvantageous. With this apparatus any such splashed drops will fall back into the reservoir and cannot approach the seal 7, whereas with the prior art system using the seals above the reservoir but around the dip tube the compound could build up at the seals.

From the bottom of the through bore 10 in the shaft 9, the suspension is distributed to the orbiting lining stations where its discharge will be controlled by a dispensing valve at the lining station so that this will initiate lowering of the level of liquid compound within the reservoir 1, to be compensated for by the opening of the valve 6 in response to an appropriate control signal from the sensor 4.

As compared with the device of GB-A-2200059 the system described above has the advantage that the exterior of the rotary union, apart from the bottom flange 16 connecting to the rotary turret, is stationary in use. Moreover, the construction is much simpler in that it uses one support bearing under the reservoir 1, on the shaft 9 and one seal 7, rather than the several seals and bearings used in the earlier construction.

By encasing the reservoir 1 within a stationary housing and mounting the sensor 4 outside at the top of that stationary housing it has been possible to ensure that the signals from the sensor are extracted in the most convenient manner to the control valve 6 and that the stationary sensor will be clear of the interface of the liquid.

Although described in the context of a turret for a rotary can end lining machine, the rotary union in accordance with the present invention has many other possible applications and can handle a variety of different liquids. It is also possible to modify the arrangement specifically disclosed herein by way of example. For example an additional high liquid level sensor may be installed as a safety feature to shut off a safety valve mounted in tandem with the valve B in the unlikely event that the liquid level rises too high in the reservoir 1.

I claim:

1. A rotary union for distributing a flow of liquid to an orbiting use location, comprising a rotatable reservoir (1), a stationary dip tube (3) for introducing liquid flow into said rotatable reservoir, means for detecting the level of liquid in said reservoir for controlling liquid-admission means to said dip tube (3), and liquid exit means from said rotatable reservoir for distributing said flow to the orbiting use location, characterized in that said reservoir is an upwardly open reservoir cup (1) surrounding the dip tube; in that a stationary housing (2) surrounds said rotatable upwardly open reservoir cup (1); in that said liquid exit means comprises a hollow shaft (9) extending downwardly from the floor of said reservoir cup (1) centered on the axis of rotation of the reservoir cup and passing through a stationary floor (8) of said stationary housing (2); and in that said liquid level detecting means comprises a sensor (4) in the ceiling of said stationary housing (2).

2. A rotary union according to claim 1, characterized by further including rotary seal means (7) below the reservoir floor to seal against escape of liquid from within said stationary housing (2) between the exterior of the downwardly extending shaft (9) and the adjacent stationary floor (8) of the stationary housing (2).

3. A rotary union according to claim 2, characterized in that said seal means (7) is a face seal.

4. A rotary union according to claim 1, 2 or 3, characterized in that said sensor (4) is accessible from outside said stationary housing (2).

5. A rotary union according to claim 1, 2 or 3, characterised by including means (11–14) for applying positive gas pressure to the interior of said housing.

6. A rotary union according to any one of claims 1 to 3, characterized in that said liquid-admission means comprises a solenoid-operated valve (6) whose solenoid is controlled in response to signals from said sensor (4).

* * * * *